United States Patent [19]

Lovat

[11] 4,067,201

[45] Jan. 10, 1978

[54] DEVICE FOR ERECTING A SEGMENTED TUNNEL WALL LINING

[76] Inventor: Richard Lovat, 42 Grovetree Avenue, Rexdale, Ontario, Canada

[21] Appl. No.: 707,440

[22] Filed: July 21, 1976

[51] Int. Cl.[2] ..... E21D 11/08

[52] U.S. Cl. ..... 61/84; 61/45 R

[58] Field of Search ..... 61/84, 85, 45, 63; 294/89, 81 R

[56] References Cited

U.S. PATENT DOCUMENTS

| | | | |
|---|---|---|---|
| 1,484,188 | 2/1924 | O'Rourke | 61/84 |
| 3,206,243 | 9/1965 | Miles | 294/81 R |
| 3,247,675 | 4/1966 | Winberg | 61/84 |
| 3,859,810 | 1/1975 | Winberg | 61/84 |

*Primary Examiner*—Jacob Shapiro

[57] ABSTRACT

A device for positioning segments to line a tunnel wall. An axially rotatable drive shaft carries at one end of an articulated arm with pivotably connected upper and lower arm members. A jack interconnects the two arms intermediate their ends. The upper arm member is pivotably connected at its free end to the drive shaft on an axis normal both to the shaft and to the upper arm member, and the arm lies in a plane through the normal axis. Preferably a shoe is detachably connectable to the lower arm member and to a segment to be positioned against the tunnel wall.

8 Claims, 8 Drawing Figures

DEVICE FOR ERECTING A SEGMENTED TUNNEL WALL LINING

This invention relates to a device for erecting a lining for a tunnel wall in association with the operation of an earth tunnelling machine.

As a tunnelling machine bores through the earth the passage created by the machine must be provided with a permanent tubular wall lining preferably using either timber, concrete or steel. An example of a tunnelling machine and a timber lining is shown in my copending U.S. patent application Ser. No. 615,899 filed Sept. 23, 1975. Where concrete or steel is used as a liner it is preferable to perform arcuate slabs or segments and fit the segments into abutting relationship as the tunnelling machine advances. However, because of their weight the performed segments are difficult to handle, especially those that must be placed against in the upper portion of the tunnel wall.

It is an object of the present invention to provide a device for placing preformed segments along a tunnel wall to form a lining. The present invention achieves this object by a device comprising: drive means having an axially rotatable shaft, and means to support the drive means whereby the drive shaft is substantially coincident with the axis of the tunnel; an articulated arm having an upper arm member and a lower arm member pivotably connected therewith, the upper arm member being pivotably connected to the drive shaft on an axis normal to the shaft and to the upper arm member, the arm lying in a plane through said normal axis; extendable means interconnecting the lower and upper arm members intermediate their ends; and means on the free end portion of the lower arm member to attach a segment releasably thereto. Preferably the attachment means includes a shoe releasable from the lower arm member, and means one the shoe for releasably attaching the shoe to a segment. dr An example embodiment of the invention is shown in the accompanying drawings in which:

Figure 1:
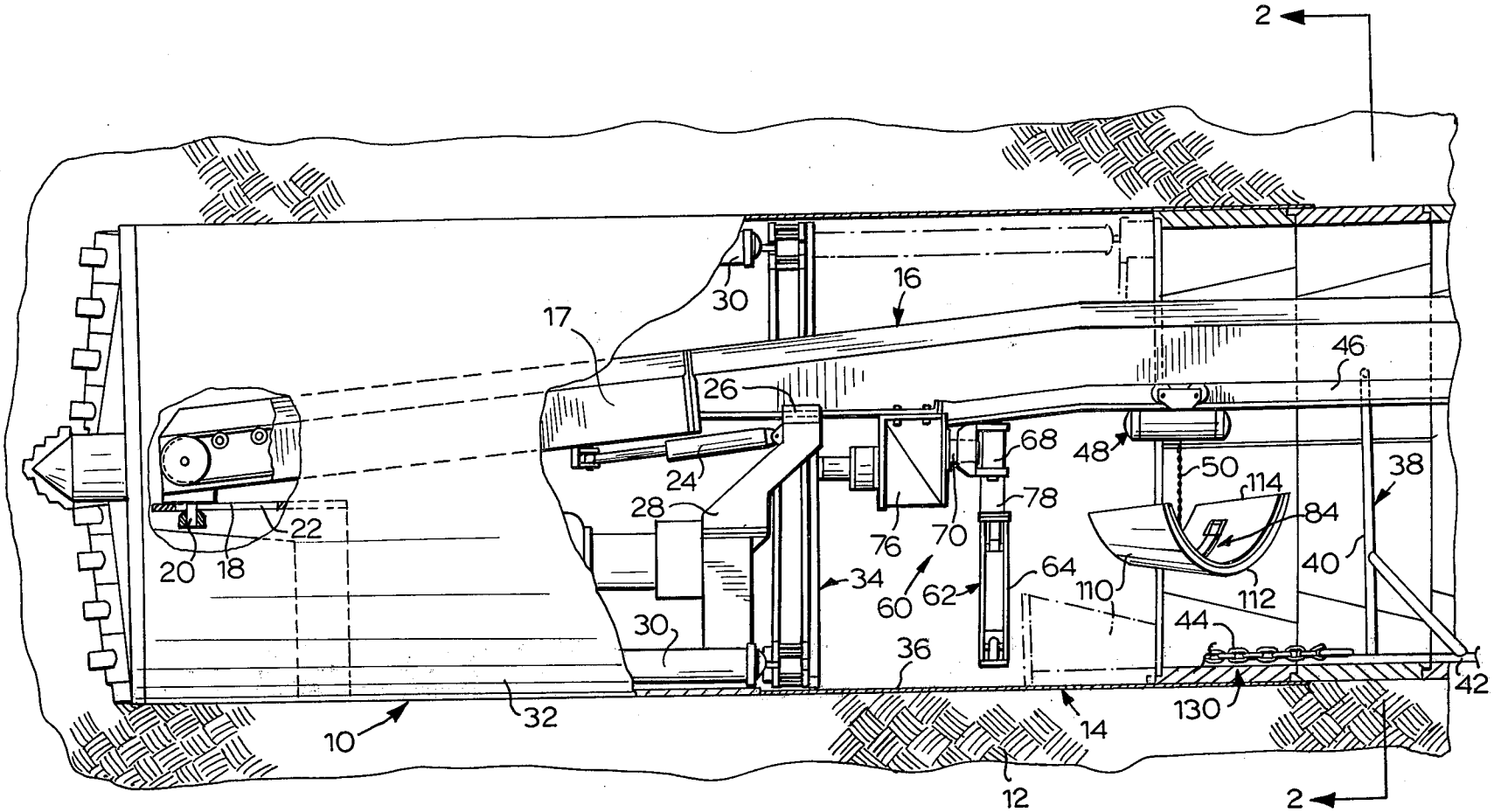
FIG. 1 is a vertical view in cross-section of a tunnelling machine located in the earth and an associated lining segment placement device.
Figure 2:
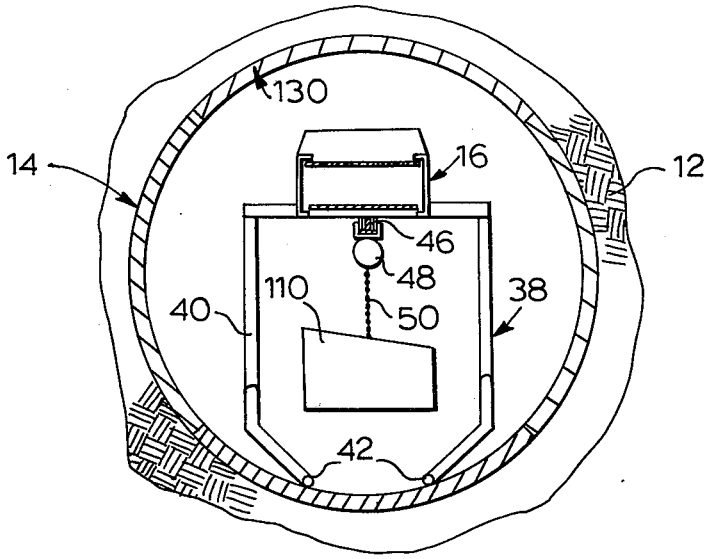
FIG. 2 is a cross-sectional view taken along line 2—2 of FIG. 1.

FIG. 1 of the drawings shows a tunnelling machine 10 of the type disclosed in my above-mentioned application Ser. No. 615,899 which moves through earth 12 to form a tunnel having a peripheral wall 14. Tunnelling machine 10 includes a conveyor 16 having a forward portion 17 which is mounted at one end on a bracket 18 by a pin 20 slidably movable in a slot 22 for fore and aft adjustment of the conveyor which is provided by a hydraulic jack 24. The forward portion of conveyor 16 within tunnelling machine 10 engages a slide 26 which is mounted on a fixed support 28. One end of jack 24 is pivotably connected to the underside of conveyor 16 and the other end of the jack is pivotably connected to support 28. A plurality of hydraulic jacks 30 are mounted adjacent cylindrical housing 32 of tunnelling machine 10. A pusher ring 34 is extendable rearwardly of housing 32 by jacks 30. Housing 32 includes a cylindrical trailing skirt 36.

Conveyor 16, extending rearwardly of tunnelling machine 10 through tunnel 14, is mounted on a skid support 38 having legs 40 spaced apart and interconnected at their lower ends by a pair of parallel skids 42. A chain 44, attached at one end to skids 42, is connectable to housing 32 when required to draw skid support 38 forward in tunnel 14. A centre rail 46 is fixed longitudinally beneath conveyor 16 and provides a track for a travelling hoist 48 suspending a lift chain 50 carrying a hook 52 at its free end.

Figure 5:
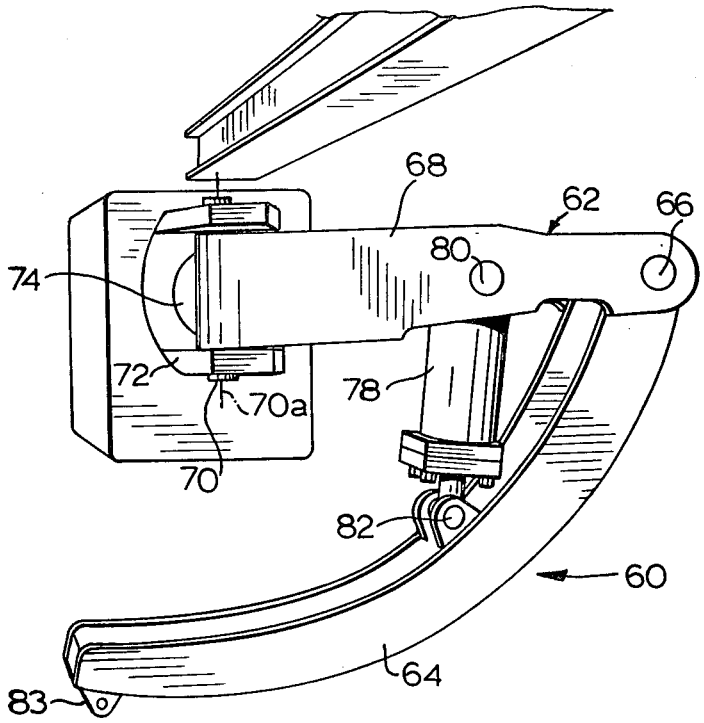
FIG. 5 is a perspective view of the placement device.

A placement device 60, seen more particularly in FIG. 5 of the drawings, is mounted on the underside of conveyor 16 and comprises an articulated arm 62 having an arcuate lower arm member 64 pivotably connected by a pin 66 to an upper arm member 68. The free end of the upper arm member is pivotably supported by a pin 70 on a yoke 72 which is integral with a drive shaft 74. A drive assembly 76 rotates drive shaft 74 on its axis **74*a* (see FIG. 6) which is normal to the axis 70*a* of pin 70. Thus arm 62 lies in a plane through the axis of pin 70. Lower arm member 64 is arcuate about axis 74*a* of drive shaft 74. Drive assembly 76 is fixed to the underside of conveyor 16. Upper and lower arm members 64 and 68 are interconnected, intermediate their ends, by a hydraulic jack 78 which is pivotably connected at one end by a pin 80 to upper arm member 68 and at the other end by a pin 82 to lower arm member 64. An apertured boss 83 is integral with the free end of lower arm member 64**.

Figure 4:
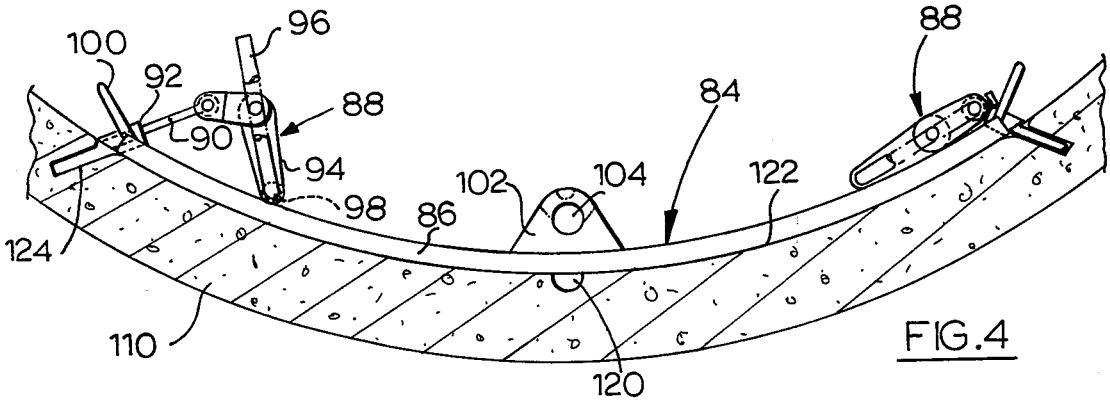
FIG. 4 is a cross-sectional view of a lining segment carried by the placement device.

A shoe 84, shown particularly in FIG. 4, is releasably connectable to placement device 60. Shoe 84 comprises an elongated arcuate member 86 rectangular in cross-section and having a radius of curvature substantially the same as that of tunnel wall 14. Each end of member 86 carries a gripping device 88 which comprises a tongue 90 slidable through a channel 92 fixed on the end of member 86. Tongue 90 is pivotably attached at one end to a pair of parallel toggles 94 which are fixedly connected at their other ends to a handle 96 held on member 86 by a pair of brackets 98 and rotatable in the brackets. A carrying handle 100 is fixed on each end of member 86. An apertured yoke 102 centrally located on member 86 is pivotably connectable by a removable pin 104 to boss 83 on lower arm 64 of placement device 62.

Figure 3:
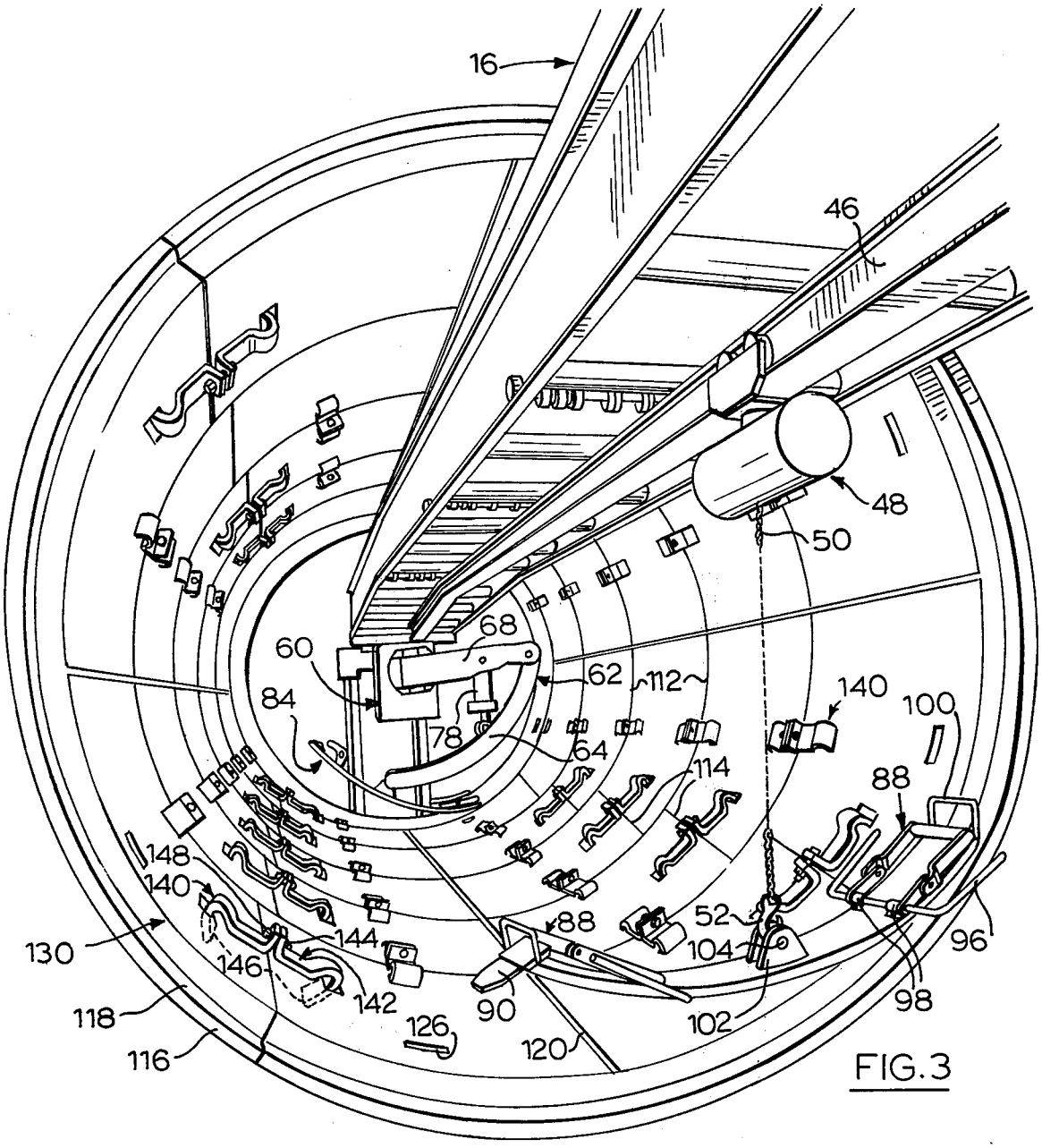
FIG. 3 is a perspective view of a lined tunnel showing the placement device of FIG. 1 in operation.

Precast concrete lining segments 110 are shown particularly in FIGS. 1, 3 and 4 of the drawings for use to form an annular section of the tunnel lining. In the example embodiment four segments 110 form each annular section. Each segment 110 is trapezoidal in shape and arcuate with the radius of curvature substantially the same as that of tunnel wall 14. The arcuate sides 112 of each segment 110 are parallel while the straight sides 114 of each segment are convergent viewing the segment as flattened. Also, sides 112 are stepped to provide a shoulder 116 and a recess 118, the shoulders and recesses being inverted on opposite sides for interlocking with abutting segments. A central groove 120 is located on the concave surface 122 of segment 110 normal to sides 112. Each segment 110 has a pair of slots 124 one adjacent each side 114 and centrally located between sides 112, the slots entering from concave surface 122 and diverging one from the other as seen in FIG. 4. Each segment 110 has a further pair of slots 126 one adjacent each side 112 and centrally located between sides 114, the slots entering from concave surface 122 and diverging one from the other.

In the operation of the example embodiment of the invention a plurality of segments 110 are prefabricated for fitting together to form a lining 130 along the wall of tunnel 14. Segments 110 are stacked in a location accessible to hoist 48 and the hoist transports the segments individually to placement device 60. To transport each segment 110, shoe 84 is placed on concave surface 122 of the segment as seen in FIG. 4 and tongues 90 are advanced by handles 96 into slots 124. Pin 104 is engaged by hook 52 of hoist 48 and segment 110 is then lifted and transported by the hoist, which travels along rail 46, and deposited adjacent placement device 60 in tunnelling machine 10. Hook 52 is desengaged from pin 104 and then shoe 84, with segment 110, is attached to apertured boss 83 of lower arm 64 by pin 104. If it is necessary to move placement device 60 along the axis of tunnel 14 to locate the device directly over segment 110, conveyor 16 is moved longitudinally by jack 24.

Figure 6:
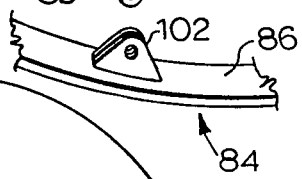
FIGS. 6, 7 and 8 are diagrammatic views of the placement device showing lining segments being positioned in various locations around the tunnel wall.
Figure 6:
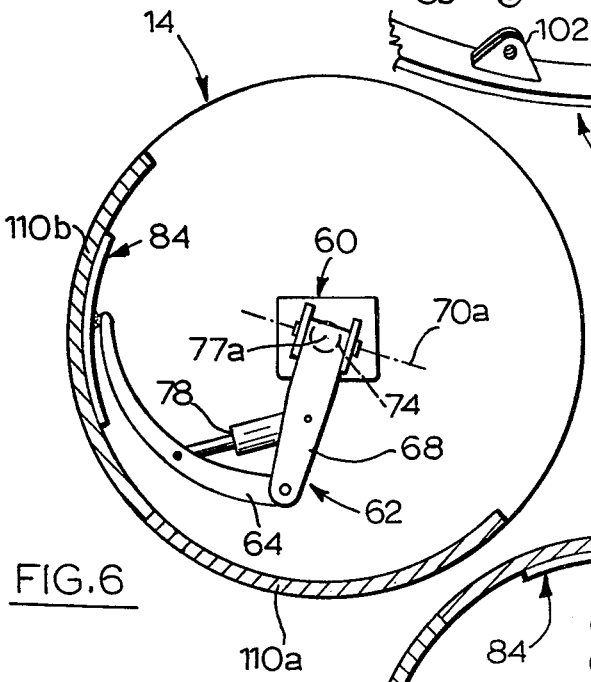
Figure 7:
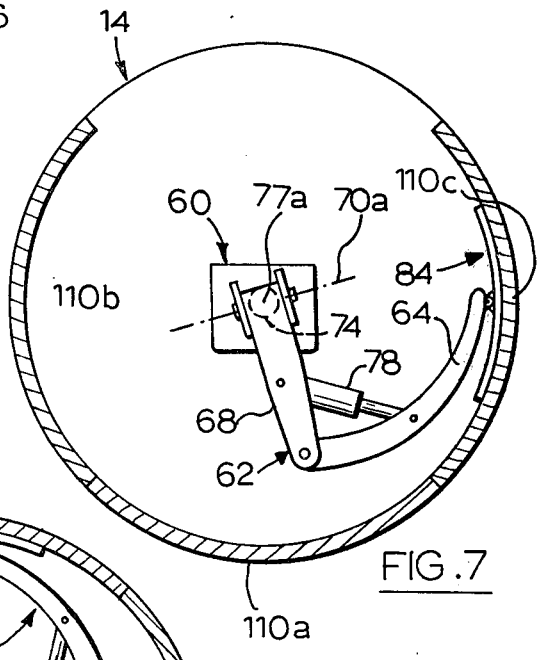
Figure 8:
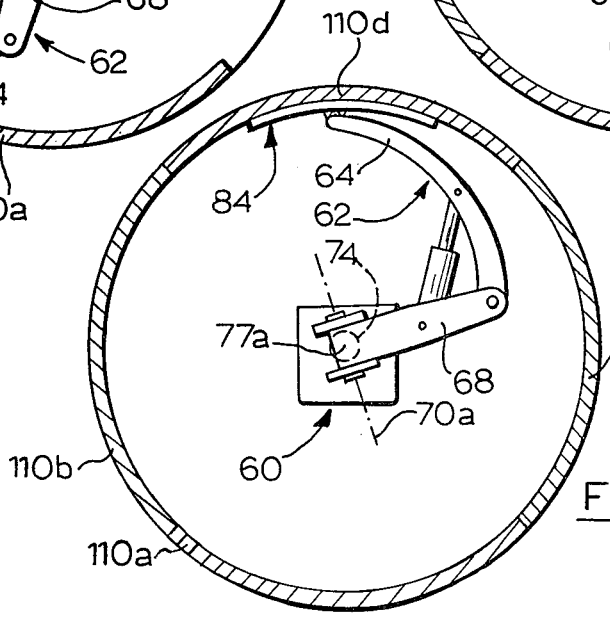

Segments 110 are positioned circumferentially against tunnel wall 14 in sequence as shown diagrammatically in FIGS. 6, 7 and 8 of the drawings to form a series of interlocking annular sections or rings along the tunnel as seen in FIG. 1. First segment 110*a* is positioned in the lower portion of tunnel wall 14 as seen in FIG. 6. Segment 110*a* can be located on wall 14 by a minor manipulation of placement device 60 whereby articulated arm 62 is moved into a plane normal to the axis of tunnel wall 14 and jack 78 is actuated first to lift and then to lower the segment. Rotation of drive element 76 about axis 77 in either direction locates segment 110*a* circumferentially on wall 14 of the tunnel. Shoe 84 is detached from segment 110*a* by rotating handles 96 to withdraw tongues 90 from slots 124 of the segment.

Second segment 110*b* is positioned against one lateral side of tunnel wall 14 by manipulating placement device 60 in the manner shown in FIG. 6. To achieve this, articulated arm 62 must first be pivoted, from its position as shown in FIG. 5, clockwise about axis 77 of drive element 74. After drive element 74 has been rotated, jack 78 is actuated to move the segment against wall 14. Further rotation of arm 62 about axis 77 moves segment 110*b* into abutting relationship with segment 110*a*.

Third segment 110*c* is positioned against tunnel wall 14 as shown in FIG. 7 of the drawings. This is effected by pivoting arm 62 180° about pivot pin 70 to have the arm lie in a plane normal to axis 77 (reverse to that shown in FIG. 5). Segment 110*c* is picked up by arm 62 which is then pivoted about axis 77 to raise the segment to that area of wall 14 where it is to be located. Actuation of jack 78 moves segment 110*c* against wall 14 and further rotation of arm 62 about axis 77 moves the segment into abutting relationship with adjacent segment 110*a*.

Fourth segment 110*d* completes the ring of lining 130. From the position shown in FIG. 7 of the drawings arm 62 is rotated clockwise about axis 77 to enable segment 110*d* to be attached to boss 83. Arm 62 is then rotated counter-clockwise as seen in FIG. 8 to locate segment 110*d* in the region of the top of tunnel wall 14. The actuation of jack 78 moves lower arm member 64 away from upper arm member 68 to position segment 110*d* against wall 14 and into abutting relationship with adjacent segments 110*b* and 110*c*. Because of the trapezoidal shape of segments 110 it may be necessary to slide segment 110*d* between segments 110*b* and 110*c* and this can be done by sliding conveyor 16 longitudinally by jack 24.

Abutting segments 110 are locked together circumferentially by means of clamps 140 as shown in FIG. 3 of the drawings. Each clamp 140 consists of a pair of hooks 142 each having an apertured flange 144 at one end and a tongue 146 at the other end. Hooks 142 are placed back to back with tongues 146 engaged in slots 124 of adjacent segments 110 and apertured flanges 144 are fastened together by bolts 148. Succeeding rings of segments 110 are locked together by clamps 140 in the same manner with tongues 146 engaged in slots 126 of adjacent segments.

Shoulders 116 and grooves 118 of succeeding rings of segments 110 interlock as seen in FIG. 1. Also, groove 118 of the last ring of segments 110 receives pusher ring 34 of tunnelling machine 10, shown in broken lines in FIG. 1. To move tunnelling machine 10, chain 44 is connected to housing 32 and hydraulic jacks 30 are activated to push against ring 34. Segments 110 are actually fitted into position within skirt 36 of tunnelling machine 10, as seen in FIG. 1, and when the machine advances against the action of jacks 30 the segmental rings of liner 130 slide out over the trailing end of the skirt. As tunnelling machine 10 advances, conveyor 16 is dragged forwardly on skids 42 to maintain its position relative to the machine.

To erect a steel lining using placement device 60 it is merely necessary to provide a yoke 102 welded centrally on each sheet steel segment in a manner similar to that shown in FIG. 4 with respect to shoe 84. Of course boss 83 and yoke 102 could be interchanged.

I claim:

1. A device for positioning segments to form a tunnel wall lining, comprising:

drive means having an axially rotatable shaft, and means to support the drive means whereby the drive shaft is substantially coincident with the axis of the tunnel;

an articulated arm having an upper arm member and a lower arm member pivotably connected therewith, the upper arm member being pivotably connected to the drive shaft on an axis normal to the shaft and to the upper arm member, the arm lying in a plane through said normal axis;

extendable means interconnecting the lower and upper arm members intermediate their ends; and means on the free end portion of the lower arm member to attach a segment releasably thereto.

2. A device as claimed in claim 1 in which the extendable means comprises a hydraulic jack.

3. A device as claimed in claim 1 in which the lower arm member is arcuate about the axis of the drive shaft.

4. A device as claimed in claim 1 in which the drive means is slidable on the support means in the direction of the axis of the drive shaft.

5. A device as claimed in claim 1 in which the attachment means includes a shoe releasable from the lower arm member, and means on the shoe for releasably attaching the shoe to a segment.

6. A device as claimed in claim 5 in which the means for attaching the shoe to a segment comprises a pair of divergent tongues one mounted at each end of the shoe, and toggle means to move each tongue into and out of a corresponding slot in the segment.

7. A device as claimed in claim 5 in which the shoe carries a yoke centrally located thereon with a releasable bridging pin, and the free end portion of the lower arm member carries an apertured boss insertable in the yoke and engagable by the pin.

8. A device as claimed in claim 1 in which the drive shaft carries a yoke at one end thereof, the upper arm member being pin connected to the yoke.

* * * * *